US006487789B1

(12) United States Patent
Wolf et al.

(10) Patent No.: US 6,487,789 B1
(45) Date of Patent: Dec. 3, 2002

(54) HEATED CYLINDER AND PROCESS OF USING SAME

(75) Inventors: Robert Wolf, Herbrechtingen (DE); Markus Oechsle, Bartholomac (DE); Frank Wegehaupt, Böhmenkirch (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/595,878

(22) Filed: Jun. 20, 2000

(30) Foreign Application Priority Data

Jun. 28, 1999 (DE) ..... 199 29 520

(51) Int. Cl.[7] ..... D06F 58/00

(52) U.S. Cl. ..... 34/114; 34/128; 34/420

(58) Field of Search ..... 34/114, 110, 128, 34/115, 119, 122, 420, 452, 454

(56) References Cited

FOREIGN PATENT DOCUMENTS

DE 3525950 12/1986

*Primary Examiner*—Teresa Walberg
*Assistant Examiner*—Fadi H. Dahbour
(74) *Attorney, Agent, or Firm*—Greenblum & Bernstein, P.L.C.

(57) ABSTRACT

Heated cylinder and process of using same for heating a fibrous material web in machines for one of producing and refining the fibrous material web. The heated cylinder includes a cylinder jacket having an outer jacket layer with good heat conductivity, a heat insulating layer positioned contiguous to and inside of the outer jacket layer, and at least one heating system positioned outside the cylinder jacket adapted to heat at least a surface of the cylinder. The process includes heating a surface of the cylinder to a temperature between about 120 and 250° C. with the at least one heating system, and guiding a material web over a portion of the surface of the cylinder such that the material web contacts the surface of the cylinder for a period of at least about 50 ms.

46 Claims, 2 Drawing Sheets

HEATED CYLINDER AND PROCESS OF USING SAME

CROSS-REFERENCE TO RELATED APPLICATIONS

The present application claims priority under 35 U.S.C. §119 of German Patent Application No. 199 29 520.4, filed on Jun. 28, 1999, the disclosure of which is expressly incorporated by reference herein in its entirety.

BACKGROUND OF THE INVENTION

1. Field of the Invention

The invention relates to a heated cylinder for drying a fibrous material web, particularly a paper, cardboard, or tissue web in machines for producing or refining the same, including a cylinder jacket whose outer layer exhibits good heat conductivity.

2. Discussion of Background Information

Drying cylinders of this kind are generally known and are usually heated with steam from the inside. Additional external heating elements can be provided based upon induction heating technology. Here, an equalization of temperature is reached between the internal and external side of the cylinder jacket, which limits the maximum surface temperature of the drying cylinder.

In addition, metal drying cylinders of this kind, for reasons of production and strength, have a large jacket thickness. The low heat resistance associated therewith also limits the maximum temperature difference between individual heating zones along the drying cylinder. An additional factor is the relatively long periods required for the cylinder material to heat up and cool down.

SUMMARY OF THE INVENTION

The object of the invention is therefore to increase the maximum surface temperature of the cylinder jacket in a heated cylinder and to improve the heat flow proceeding from the heating unit to the fibrous material web via the cylinder jacket.

According to the invention, this goal is achieved in that at least one heating system positioned outside the cylinder is assigned to the outer jacket layer for the purpose of heating and in that a heat-insulating layer lies contiguous to the outer jacket layer but inside the cylinder jacket. This insulation prevents heat flow to the internal part of the cylinder, with the result both that greater surface temperatures are possible and that a large quantity of heat can be released from the heating system to the fibrous material web. The insulation also renders unnecessary an internal heating system for the cylinder jacket.

To reduce the heating up and cooling off periods, the external jacket layer should preferably include metal and be as thin as possible. This also increases the maximum temperature difference between the different heating zones.

Even for the case in which the external jacket layer is among the essential factors determining the stability of form and the strength of the cylinder, it is desirable for the thickness of the external jacket layer to be less than about 30 mm, preferably less than about 5 mm.

However, if the stability of form and strength of the cylinder are primarily determined by the insulating layer and/or by a support structure within the cylinder jacket and contiguous to the insulating layer, it is advantageous if the external jacket layer has a thickness of less than about 5 mm, ideally less than about 1 mm, and particularly less than about 0.2 mm.

The support structure may include metal, in which case the thermal effect of an induction heating system must be taken into account.

Lighter cylinders generally result, however, when the supporting insulting layer and/or the supporting structure include a fiber-reinforced, thermally insulating plastic. This means that the insulating layer and the support structure can optionally also form a single element of the cylinder jacket, one that is structured or multi-layered.

Under certain circumstances, advantages with respect to stability and strength, or advantages relating to production, will also result if the insulating layer and/or the supporting structure occupy at least a considerable portion of the inner compartment of the cylinder; ideally they will occupy the entirety of the inner compartment.

The diameter of the cylinder determines the jacket surface to be heated, which in turn limits the maximum diameter; at the same time, however, it has an effect on the period of contact with the fibrous material web, which results in a minimum.

Particularly good results were achieved with cylinders whose diameters lie in the range of about 500 to 3000 mm, preferably between about 1200 and 1800 mm.

To profile the moisture distribution crosswise to the fibrous material web, the heating system will preferably include an infrared and/or induction heating system and should have a plurality of heating zones along the cylinder which can be separately controlled and which should have a zone width of preferably less than about 200 mm. The optimal zone width will be determined by the expense of the heating system and by the heat flow between the heating zones. Good results can be achieved with zone widths in a range of about 30 to 100 mm, chiefly in a range between about 40 and 75 mm.

In this connection, the heat flow between the heating zones can be further reduced if the external jacket layer has a reduced thickness in the area between the heating zones. This can be achieved in a simple manner, with a narrow circumferential groove, preferably one that runs outward and does not compromise the quality of the fibrous material web.

To efficiently influence the moisture distribution or the drying of the fibrous material web overall, while avoiding heat damage to the web surface, the maximum surface temperature of the cylinder should lie between about 120 and 250° C., preferably between about 150 and 200° C. To this end, it is usually necessary for the entire available heating capacity to be at least about 60 kW/m for a cylinder diameter of up to about 1200 mm; for a cylinder diameter between about 1200 and 1800 mm it should be at least about 80 kW/m, and for a cylinder diameter of greater than about 1800 mm at least about 120 kW/m.

In addition, in order to guarantee a sufficient heat flow to the fibrous material web, the contact period of the cylinder with the fibrous material web should be at least about 50 ms, preferably a minimum of about 80 ms, and particularly a minimum of about 120 ms.

The present invention is directed to a heated cylinder for heating a fibrous material web in machines for one of producing and refining the fibrous material web. The heated cylinder includes a cylinder jacket having an outer jacket layer with good heat conductivity, a heat insulating layer positioned contiguous to and inside of the outer jacket layer, and at least one heating system positioned outside the cylinder jacket adapted to heat at least a surface of the cylinder.

In accordance with a feature of the present invention, the fibrous material can be one of a paper, a cardboard, and a tissue web.

According to another feature of the instant invention, the outer jacket layer can include metal. A stability of form and strength of the cylinder may be fundamentally determined by the outer jacket layer. The outer jacket layer can have a thickness of less than about 30 mm, and preferably less than about 5 mm. Further, greater than 80% of the shape stability and firmness of the cylinder can be determined by the outer jacket layer. Moreover, other materials, such as those utilized in standard dry cylinders, can be used for the outer jacket layer.

In accordance with another feature of the invention, the insulating layer fundamentally determines a stability of form and strength of the cylinder. The insulating layer may include a fiber-reinforced plastic (GFK or CFK). Further, the outer jacket layer has a thickness of less than about 5 mm, preferably less than about 1 mm, and, in particular, less than about 0.2 mm. Further, greater than 80% of the shape stability and firmness of the cylinder can be determined by the insulating layer.

According to still another feature of the instant invention, a supporting structure may be positioned contiguous to and inside the insulating layer. A stability of form and strength of the cylinder may be fundamentally determined by at least one of the insulating layer and the supporting structure. For example, greater than 80% of the shape stability and firmness of the cylinder can be determined by the supporting structure adjacent to the insulating layer. The supporting structure can include metal, e.g., steel or cast steel. Alternatively, or additionally, at least one of the supporting insulating layer and the supporting structure may include a fiber-reinforced plastic, e.g., GFK or CFK. Further, the outer jacket layer can have a thickness of less than about 5 mm, preferably less than about 1 mm, and, in particular, less than about 0.2 mm. Still further, at least one of the insulating layer and the supporting structure may fill up an essential portion of an inner area of the cylinder, and preferably can fill up an entirety of the inner area. Alternatively, an inner area of the cylinder can be empty.

In accordance with a still further feature of the instant invention, a diameter of the cylinder can lie in a range from about 500 to 3000 mm, and preferably about 1200 to 1800 mm.

According to still another feature of the present invention, the heating system can include at least one of an infrared and an induction heating system.

Further, the heating system may include a plurality of separately controllable heating zones arranged along the outer jacket layer. The plurality of heating zones may have a zone width of less than about 200 mm, preferably in a range from about 30 to 100, and, in particular, in a range from about 40 to 75 mm. The outer jacket layer may have a reduced thickness in an area between the heating zones. Further, the reduced thickness areas can include a narrow circumferential groove, and the narrow circumferential groove can be arranged on an outside of the outer jacket layer.

Moreover, the surface of the cylinder can be heatable to a maximum surface temperature between about 120 and 250° C., and preferably between about 150 and 200° C.

In accordance with another feature of the invention, an entire available heating capacity can be at least about 60 kW/m for a diameter of the cylinder up to about 1200 mm. Further, an entire available heating capacity can be at least about 80 kW/m for a diameter of the cylinder between about 1200 and 1800 mm. Still further, an entire available heating capacity can be at least about 120 kW/m for a diameter of the cylinder greater than about 1800 mm.

In accordance with a still further feature of the present invention, a contact period between the surface of the cylinder and the fibrous material web is at least about 50 ms, preferably at least about 80 ms, and, in particular, at least about 120 ms.

According to still another feature of the instant invention, the cylinder jacket can be located on a grid-like supporting structure, and the insulating layer may be air within the grid-like supporting structure.

The present invention is also directed to a process of using a heated cylinder including a cylinder jacket having an outer jacket layer with good heat conductivity, a heat insulating layer positioned contiguous to and inside of the outer jacket layer, and at least one heating system positioned outside the cylinder jacket. The process includes heating a surface of the cylinder to a temperature between about 120 and 250° C. with the at least one heating system, and guiding a material web over a portion of the surface of the cylinder such that the material web contacts the surface of the cylinder for a period of at least about 50 ms.

In accordance with a feature of the invention, the at least one heating system can include a plurality of heating zones, and the outer jacket layer can include reduced thickness areas located between the heating zones. Further, the heating of the surface can include sectionally heating the outer jacket layer between the areas of reduced thickness. In this manner, the areas of reduced thickness reduce heat flow between zones formed by the areas of reduced thickness.

According to still another feature of the present invention, the surface of the cylinder is heatable to a maximum surface temperature between about 150 and 200° C.

In accordance with another feature of the invention, the contact period is at least about 80 ms, and, in particular, at least about 120 ms.

According to yet another feature of the instant invention, for a cylinder diameter up to about 1200 mm, an entire available heating capacity can be at least about 60 kW/m. For a cylinder diameter of between about 1200 and 1800 mm, an entire available heating capacity can be at least about 80 kW/m. For a cylinder diameter greater than about 1800 mm, an entire available heating capacity can be at least about 120 kW/m.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
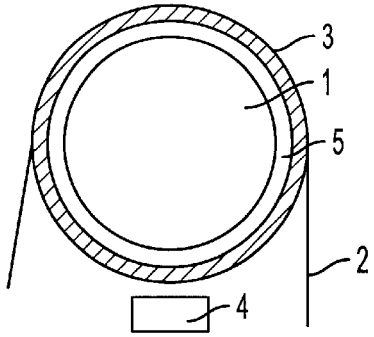
FIG. 1 illustrates a schematic cross-section of a cylinder 1 with an insulating layer 5.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

All heated cylinders 1 here include a cylinder jacket whose outer metallic jacket layer 3 exhibits good heat conductivity. In addition, an inductive heating system 4 positioned outside of the cylinder 1 is assigned to this jacket layer 3. Within the cylinder jacket, a heat insulating layer 5 lies contiguous to the outer jacket layer 3 in order to limit the heat flow.

In FIG. 1, the stability of form and the strength of the cylinder 1 is assured by the outer jacket layer 3, which exhibits a thickness of, e.g., about 4 mm, and by the insulating layer 5, which also has a support function. This simplifies the design, and the insulating layer 5 include fiber-reinforced plastic. The cylinder 1 is produced by thermally shrinking the metallic jacket layer 3, e.g., steel or cast steel, onto the insulating layer 5.

Figure 2:
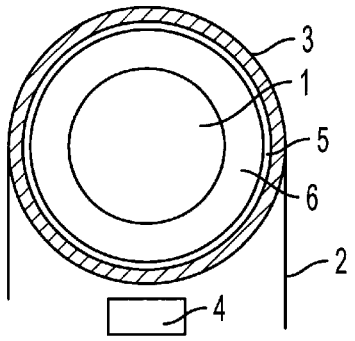
FIG. 2 illustrates a schematic cross-section of a cylinder 1 with an insulating layer 5 and a supporting structure 6.
Figure 3:
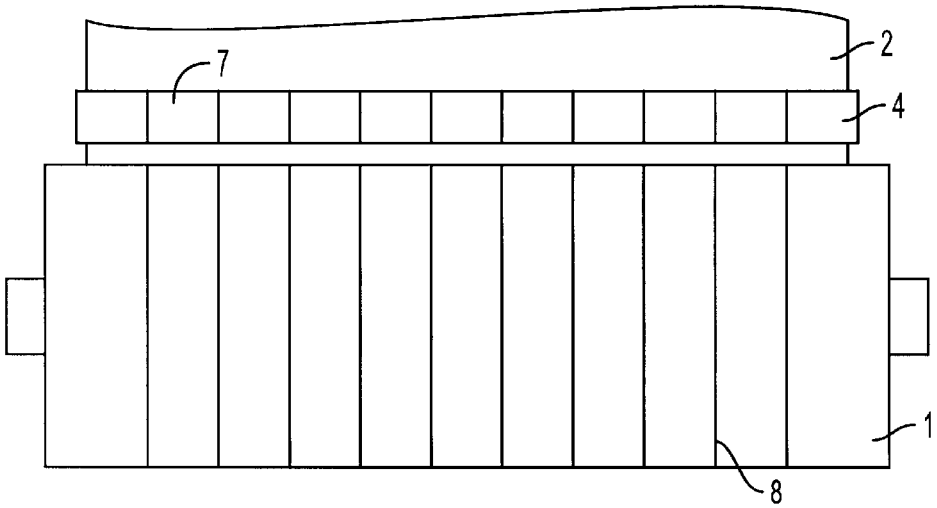
FIG. 3 illustrates a schematic top view of a cylinder 1.

In contrast hereto, the outer jacket layer 3 in FIG. 2 hardly has a support function and can therefore be limited to a thickness of less than 1 mm. This reduces the heat flow along the cylinder 1, so that the adjustments can be set for greater temperature differences on the jacket surface.

The insulating layer 5 includes a plastic with the lowest heat conductivity and a support structure 6 contiguous thereto within the cylinder jacket. In the exemplary embodiment, support structure 6 occupies a large part of the interior of the cylinder 1. This makes possible a light and very stable support structure 6. Preferably, an inner portion of support structure 6 can be empty or air filled.

The cylinders 1 likewise have, e.g., a diameter of about 1500 mm, in which case the guidance of the fibrous material web will have a contact period of about 120 ms.

The heating system 4 along the cylinder 1 is divided into a plurality of separately controllable heating zones 7, with a zone width of about 50 mm. Given an available heating capacity of about 100 kW/m, surface temperatures of about 200° C. can be achieved for the cylinder 1.

In order to the limit the heat flow between the heating zones 7, the thickness of the outer jacket layer 3 between the heating zones 7 is reduced. This is done with a very narrow circumferential groove 8 burned in with a laser from the outside. This improves the independence of the heating zones 7. For example, the depth of grooves 8 can be less than approximately 10 mm, and preferably less than approximately 3 mm, and a width of grooves 8 can be less than approximately 5 mm, and preferably less than approximately 2 mm.

Figure 4:
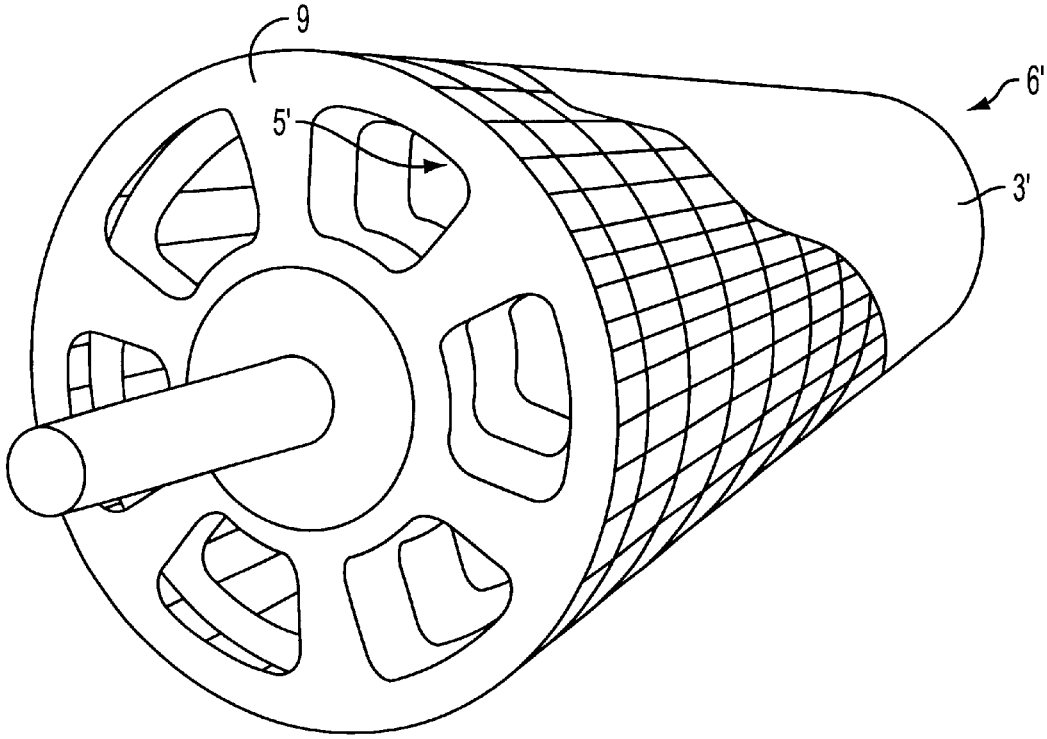
FIG. 4 illustrates an embodiment in which the insulator is air.

FIG. 4 illustrates an embodiment in which air is utilized as an insulator. In particular, the cylinder includes a honeycomb structure (i.e., latticework or grid) which forms support structure 6' over plates 9 with a number of through holes. Onto support structure 6', a thin sheet of metal, e.g., steel, is mounted from the outside to form a heat conducting structure 3'. Heat flow from the outer surface of heat conducting structure 3' is low due to the very small contact area to the honeycomb structure. Thus, the interior of the cylinder remains empty, i.e., via the through holes in plates 9, and the faces may be generally closed, except for, e.g., small bores for pressure compensation. Insulating layer 5' is formed by the air inside the cylinder.

In accordance with this embodiment, and due to the closed cylinder and the shoveling of the honeycomb chambers, the air has little (or no) speed relative to the inner wall. Therefore, a heat exchange $\alpha<10$ W/(M$^2$K) results, which provides sufficient insulation. Further, due to the closed cylinder, the air inside additionally heats up to the average temperature of the outer wall. Thus, the temperature difference between the air and the outer wall is low, which further reduces the heat flow.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket;

the at least one heating system being divided into a plurality of separately controllable adjacent heating zones, wherein the at least one heating system is adapted to profile a moisture distribution crosswise to the fibrous material web.

2. The heated cylinder in accordance with claim 1, wherein the fibrous material is one of a paper, a cardboard, and a tissue web.

3. The heated cylinder in accordance with claim 1, wherein said outer jacket layer comprises metal, wherein a stability of form and strength of said cylinder is fundamentally determined by said outer jacket layer.

4. The heated cylinder in accordance with claim 3, wherein said outer jacket layer has a thickness of less than about 30 mm.

5. The heated cylinder in accordance with claim 4, wherein said thickness of said outer jacket layer is less than about 5 mm.

6. The heated cylinder in accordance with claim 1, wherein said heat insulating layer fundamentally determines a stability of form and strength of said cylinder.

7. The heated cylinder in accordance with claim 1, further comprising a supporting structure positioned contiguous to and inside said heat insulating layer, wherein a stability of form and strength of said cylinder is fundamentally determined by at least one of said heat insulating layer and said supporting structure.

8. The heated cylinder in accordance with claim 7, wherein said supporting structure comprises metal.

9. The heated cylinder in accordance with claim 7, wherein said outer jacket layer has a thickness of less than about 5 mm.

10. The heated cylinder in accordance with claim 9, wherein said thickness of said outer jacket layer is less than about 1 mm.

11. The heated cylinder in accordance with claim 7, wherein at least one of said heat insulating layer and said supporting structure fill up an essential portion of an inner area of said cylinder.

12. The heated cylinder in accordance with claim 7, wherein an inner area of said cylinder is empty.

13. The heated cylinder in accordance with claim 7, wherein an inner area of said supporting structure is not filled.

14. The heated cylinder in accordance with claim 1, wherein a diameter of said cylinder lies in a range from about 500 to 3000 mm.

15. The heated cylinder in accordance with claim 1, wherein said at least one heating system comprises at least one of an infrared and an induction heating system.

16. The heated cylinder in accordance with claim 1, wherein at least one of said plurality of heating zones have a zone width of less than about 200 mm.

17. The heated cylinder in accordance with claim 6, wherein said heat insulating layer comprises a fiber-reinforced plastic.

18. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer;

at least one heating system positioned outside said cylinder jacket adapted to heat at least a surface of said cylinder jacket;

said heat insulating layer fundamentally determining a stability of form and strength of said cylinder; and said heat insulating layer comprising a fiber-reinforced plastic, wherein said outer jacket layer has a thickness of less than about 5 mm.

19. The heated cylinder in accordance with claim 18, wherein said thickness of said outer jacket layer is less than about 1 mm.

20. The heated cylinder in accordance with claim 18, wherein said thickness of said outer jacket layer is less than about 0.2 mm.

21. The heated cylinder in accordance with claim 7, wherein at least one of said heat insulating layer and said supporting structure comprises a fiber-reinforced plastic.

22. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer;

at least one heating system positioned outside said cylinder jacket adapted to heat at least a surface of said cylinder jacket;

a supporting structure positioned contiguous to and inside said heat insulating layer, wherein a stability of form and strength of said cylinder is fundamentally determined by at least one of said heat insulating layer and said supporting structure; and said outer jacket layer having a thickness of less than about 5 mm, wherein said thickness of said outer jacket layer is less than about 0.2 mm.

23. The heated cylinder in accordance with claim 11, wherein said at least one of said heat insulating layer and said supporting structure fill up an entirety of said inner area.

24. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer;

at least one heating system positioned outside said cylinder jacket adapted to heat at least a surface of said cylinder jacket; and a diameter of said cylinder being in a range from about 500 to 3000 mm, wherein said diameter is within a range from about 1200 to 1800 mm.

25. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket;

the at least one heating system comprising a plurality of separately controllable heating zones arranged along said outer jacket layer, wherein at least one of said plurality of heating zones have a zone width of less than about 200 mm, and wherein said zone width lies in a range from about 30 to 100.

26. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket;

the at least one heating system comprising a plurality of separately controllable heating zones arranged along said outer jacket layer, wherein at least one of said plurality of heating zones have a zone width of less than about 200 mm, and wherein said zone width is in a range from about 40 to 75 mm.

27. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket;

the at least one heating system comprising a plurality of separately controllable heating zones arranged along said outer jacket layer, wherein said outer jacket layer has a reduced thickness in an area between said heating zones.

28. The heated cylinder in accordance with claim 27, wherein said reduced thickness areas include a narrow circumferential groove.

29. The heated cylinder in accordance with claim 28, wherein said narrow circumferential groove is arranged on an outside of said outer jacket layer.

30. The heated cylinder in accordance with claim 1, wherein said surface of said cylinder jacket is heatable to a maximum surface temperature between about 120 and 250° C.

31. The heated cylinder in accordance with claim 30, wherein said surface of said cylinder jacket is heatable to a maximum surface temperature between about 150 and 200° C.

32. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket, wherein an entire available heating capacity is at least about 60 kW/m for a diameter of said cylinder up to about 1200 mm.

33. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket, wherein an entire available heating capacity is at least about 80 kW/m for a diameter of said cylinder between about 1200 and 1800 mm.

34. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket, wherein an entire available heating capacity is at least about 120 kW/m for a diameter of said cylinder greater than about 1800 mm.

35. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket, wherein a contact period between said surface of said cylinder and the fibrous material web is at least about 50 ms.

36. The heated cylinder in accordance with claim 35, wherein said contact period is at least about 80 ms.

37. The heated cylinder in accordance with claim 35, wherein said contact period is at least about 120 ms.

38. A heated cylinder for heating a fibrous material web in machines for one of producing and refining the fibrous material web, comprising:

a cylinder jacket having an outer jacket layer with good heat conductivity;

a heat insulating layer positioned contiguous to and inside of said outer jacket layer; and at least one heating system positioned outside said cylinder jacket adapted to heat at least a surface of said cylinder jacket, wherein said cylinder jacket is located on a grid-like supporting structure, and wherein said insulating layer is air within said grid-like supporting structure.

39. A process of using a heated cylinder including a cylinder jacket having an outer jacket layer with good heat conductivity, a heat insulating layer positioned contiguous to and inside of the outer jacket layer, and at least one heating system positioned outside the cylinder jacket, the process comprising:

heating a surface of the cylinder jacket to a temperature between about 120 and 250° C. with the at least one heating system; and guiding a material web over a portion of the surface of the cylinder jacket such that the material web contacts the surface for a period of at least about 50 ms.

40. The process in accordance with claim 39, wherein the at least one heating system comprises a plurality of heating zones, and the outer jacket layer includes reduced thickness areas located between the heating zones, and wherein the heating of the surface comprises sectionally heating the outer jacket layer between the areas of reduced thickness, whereby the areas of reduced thickness reduce heat flow between zones formed by the areas of reduced thickness.

41. The heated cylinder in accordance with claim 39, wherein the surface of the cylinder is heatable to a maximum surface temperature between about 150 and 200° C.

42. The heated cylinder in accordance with claim 39, wherein the contact period is at least about 80 ms.

43. The heated cylinder in accordance with claim 39, wherein the contact period is at least about 120 ms.

44. The heated cylinder in accordance with claim 39, wherein, for a cylinder diameter up to about 1200 mm, an entire available heating capacity is at least about 60 kW/m.

45. The heated cylinder in accordance with claim 39, wherein, for a cylinder diameter of between about 1200 and 1800 mm, an entire available heating capacity is at least about 80 kW/m.

46. The heated cylinder in accordance with claim 39, wherein, for a cylinder diameter greater than about 1800 mm, an entire available heating capacity is at least about 120 kW/m.

* * * * *